US011095046B2

(12) United States Patent
Ye et al.

(10) Patent No.: US 11,095,046 B2
(45) Date of Patent: Aug. 17, 2021

(54) ANTENNA STRUCTURE

(71) Applicant: WISTRON NEWEB CORPORATION, Hsinchu (TW)

(72) Inventors: Yu-Hsin Ye, Hsinchu (TW); Chin-Lien Huang, Hsinchu (TW); Kuo-Jen Lai, Hsinchu (TW)

(73) Assignee: WISTRON NEWEB CORPORATION, Hsinchu (TW)

( * ) Notice: Subject to any disclaimer, the term of this patent is extended or adjusted under 35 U.S.C. 154(b) by 0 days.

(21) Appl. No.: 16/878,662

(22) Filed: May 20, 2020

(65) Prior Publication Data

US 2021/0013630 A1 Jan. 14, 2021

(30) Foreign Application Priority Data

Jul. 12, 2019 (TW) ..... 108124710

(51) Int. Cl.

| | |
|---|---|
| ***H01Q 21/26*** | (2006.01) |
| *H01Q 21/24* | (2006.01) |
| *H01Q 21/28* | (2006.01) |
| *H01Q 1/24* | (2006.01) |
| *H01Q 5/40* | (2015.01) |
| *H01Q 21/06* | (2006.01) |

(52) U.S. Cl.

CPC ..... *H01Q 21/26* (2013.01); *H01Q 1/24* (2013.01); *H01Q 1/243* (2013.01); *H01Q 5/40* (2015.01); *H01Q 21/062* (2013.01); *H01Q 21/24* (2013.01); *H01Q 21/28* (2013.01)

(58) Field of Classification Search

CPC ..... H01Q 21/26; H01Q 21/28; H01Q 1/24; H01Q 5/40; H01Q 21/24; H01Q 1/243; H01Q 21/062; H01Q 21/065

See application file for complete search history.

(56) References Cited

U.S. PATENT DOCUMENTS

2015/0325928 A1* 11/2015 Chao ..... H01Q 21/30 343/727

OTHER PUBLICATIONS

Wen, et al.: "A Wideband Dual-Polarized Antenna Using Shorted Dipoles"; IEEE Access; accepted Jul. 2, 2018, date of publication Jul. 12, 2018, date of current version Aug. 7, 2018; pp. 39725-39733.

* cited by examiner

*Primary Examiner* — Joseph J Lauture

(74) *Attorney, Agent, or Firm* — McClure, Qualey & Rodack, LLP

(57) ABSTRACT

An antenna structure includes a substrate, a first polarization antenna group, and a second polarization antenna group. The substrate is defined with a first axis and a second axis. The first polarization antenna group and the second polarization antenna group are disposed on the substrate. The first polarization antenna group includes a first dipole antenna, a second dipole antenna, and a first wire. The first wire is separate from and coupled to the first dipole antenna and the second dipole antenna. The second polarization antenna group includes a third dipole antenna, a fourth dipole antenna, and a second wire. The second wire is separate from and coupled to the third dipole antenna and the fourth dipole antenna.

13 Claims, 9 Drawing Sheets

ANTENNA STRUCTURE

CROSS-REFERENCE TO RELATED PATENT APPLICATION

This application claims the benefit of priority to Taiwan Patent Application No. 108124710, filed on Jul. 12, 2019. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an antenna structure, and in particular, to an antenna structure in which a wire and a dipole antenna coupled to each other.

BACKGROUND OF THE DISCLOSURE

With development of 5th generation mobile communications technologies (5G), requirements on micro base stations or customer-provided equipment (CPE) have grown increasingly higher. Therefore, an antenna needs to have high gain and broadband features. In addition, in the related art, two substrates provided with antennas are mostly configured perpendicular to each other to provide two polarization directions. However, when existing products are designed to be miniaturized, it is difficult to implement such configuration in the limited space thereof Therefore, in view of the above, how an antenna structure design can be improved to overcome the foregoing defect has become one of important issues to be resolved in the related field.

SUMMARY OF THE DISCLOSURE

In response to the above-referenced technical inadequacies, the present disclosure provides an antenna structure.

To resolve the foregoing technical problem, a technical solution adopted in the present disclosure is to provide an antenna structure, including: a substrate, a first polarization antenna group, and a second polarization antenna group. The substrate is defined with a first axis and a second axis perpendicular to the first axis. The first polarization antenna group is disposed on the substrate, and the first polarization antenna group includes: a first dipole antenna, a second dipole antenna, a first wire, and a first feeding member. The first dipole antenna includes a first radiation portion, a second radiation portion, and a first connection portion connected to the first radiation portion and the second radiation portion, where a first groove is formed between the first radiation portion and the second radiation portion. The second dipole antenna includes a third radiation portion, a fourth radiation portion, and a second connection portion connected to the third radiation portion and the fourth radiation portion, where a second groove is formed between the third radiation portion and the fourth radiation portion, and the first connection portion is electrically connected to the second connection portion. The first wire is separate from and coupled to the first dipole antenna and the second dipole antenna. The first feeding member is electrically connected between the first wire and the first dipole antenna or the second dipole antenna. The first dipole antenna and the second dipole antenna are respectively disposed on two opposite sides of the first axis, and the first groove and the second groove are respectively disposed on two opposite sides of the second axis. The second polarization antenna group is disposed on the substrate, and the second polarization antenna group includes: a third dipole antenna, a fourth dipole antenna, a second wire, and a second feeding member. The third dipole antenna includes a fifth radiation portion, a sixth radiation portion, and a third connection portion connected to the fifth radiation portion and the sixth radiation portion, where a third groove is formed between the fifth radiation portion and the sixth radiation portion, and the third connection portion is electrically connected to the second connection portion. The fourth dipole antenna includes a seventh radiation portion, an eighth radiation portion, and a fourth connection portion connected to the seventh radiation portion and the eighth radiation portion, where a fourth groove is formed between the seventh radiation portion and the eighth radiation portion, and the fourth connection portion is electrically connected to the third connection portion. The second wire is separate from and coupled to the third dipole antenna and the fourth dipole antenna. The second feeding member is electrically connected between the second wire and the third dipole antenna or the fourth dipole antenna. The third dipole antenna and the fourth dipole antenna are respectively disposed on the two opposite sides of the second axis, and the third groove and the fourth groove are respectively disposed on the two opposite sides of the first axis.

A beneficial effect of the present disclosure resides in that, in the antenna structure provided in the present disclosure, by virtue of "the first dipole antenna and the second dipole antenna are respectively disposed on two opposite sides of the first axis, and the first groove and the second groove are respectively disposed on two opposite sides of the second axis" and "the third dipole antenna and the fourth dipole antenna are respectively disposed on the two opposite sides of the second axis, and the third groove and the fourth groove are respectively disposed on the two opposite sides of the first axis" gains of the antenna structure can be improved, and a bandwidth of an operating frequency band of the antenna structure can be increased.

For further understanding of features and technical content of the present disclosure, refer to the following detailed descriptions and drawings related to the present disclosure. However, the provided drawings are merely used to provide references and descriptions, and are not intended to limit the present disclosure.

DETAILED DESCRIPTION OF THE EXEMPLARY EMBODIMENTS

Figure 1:
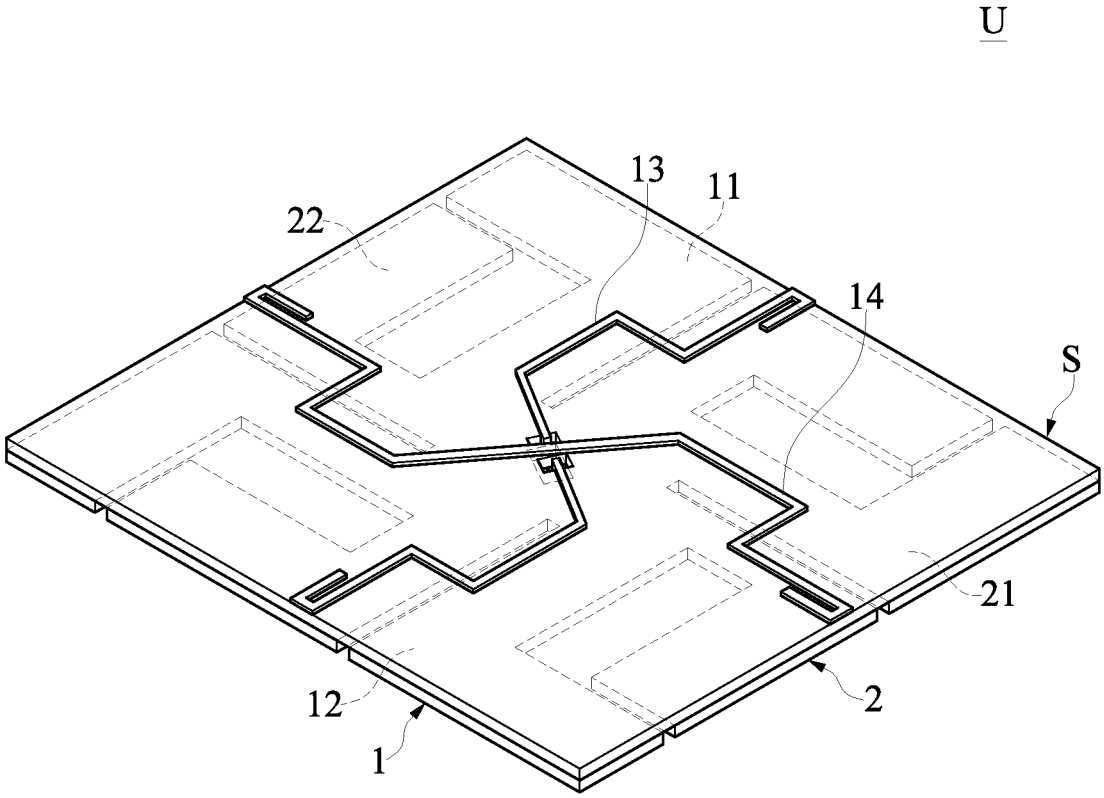
FIG. 1 is a schematic perspective view of an antenna structure according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

The following describes, through particular specific embodiments, implementations related to an "antenna structure" and disclosed in the present disclosure, and a person skilled in the art may understand advantages and effects of the present disclosure from content disclosed in this specification. The present disclosure may be implemented or applied through other different specific embodiments, and various modifications and changes may be made to details in this specification based on different views and applications without departing from concepts of the present disclosure. In addition, it is stated in advance that the accompanying drawings of the present disclosure are merely simple schematic illustrations instead of depictions according to actual sizes. The following implementations will further describe in detail related technical content of the present disclosure. However, the disclosed content is not used to limit the protection scope of the present disclosure.

It should be understood that although the terms such as "first", "second", and "third" may be used to describe various components in this specification, these components should not be limited by these terms. These terms are mainly used to distinguish between one component and another component. In addition, the term "or" used in this specification may include any one or any combination of associated listed items depending on actual situations.

First Embodiment

Figure 2:
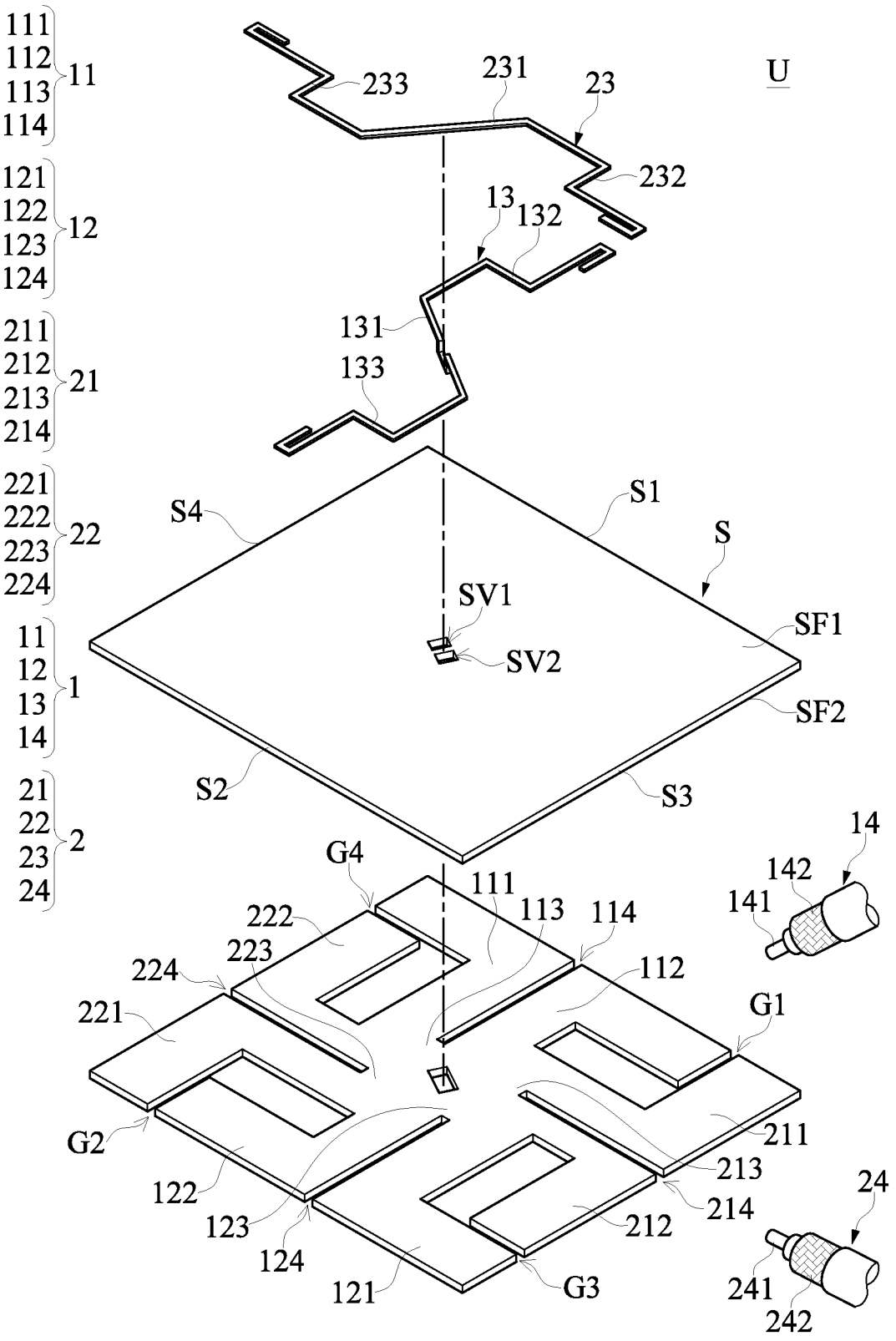
FIG. 2 is a schematic perspective exploded view of the antenna structure according to the first embodiment of the present disclosure.
Figure 3:
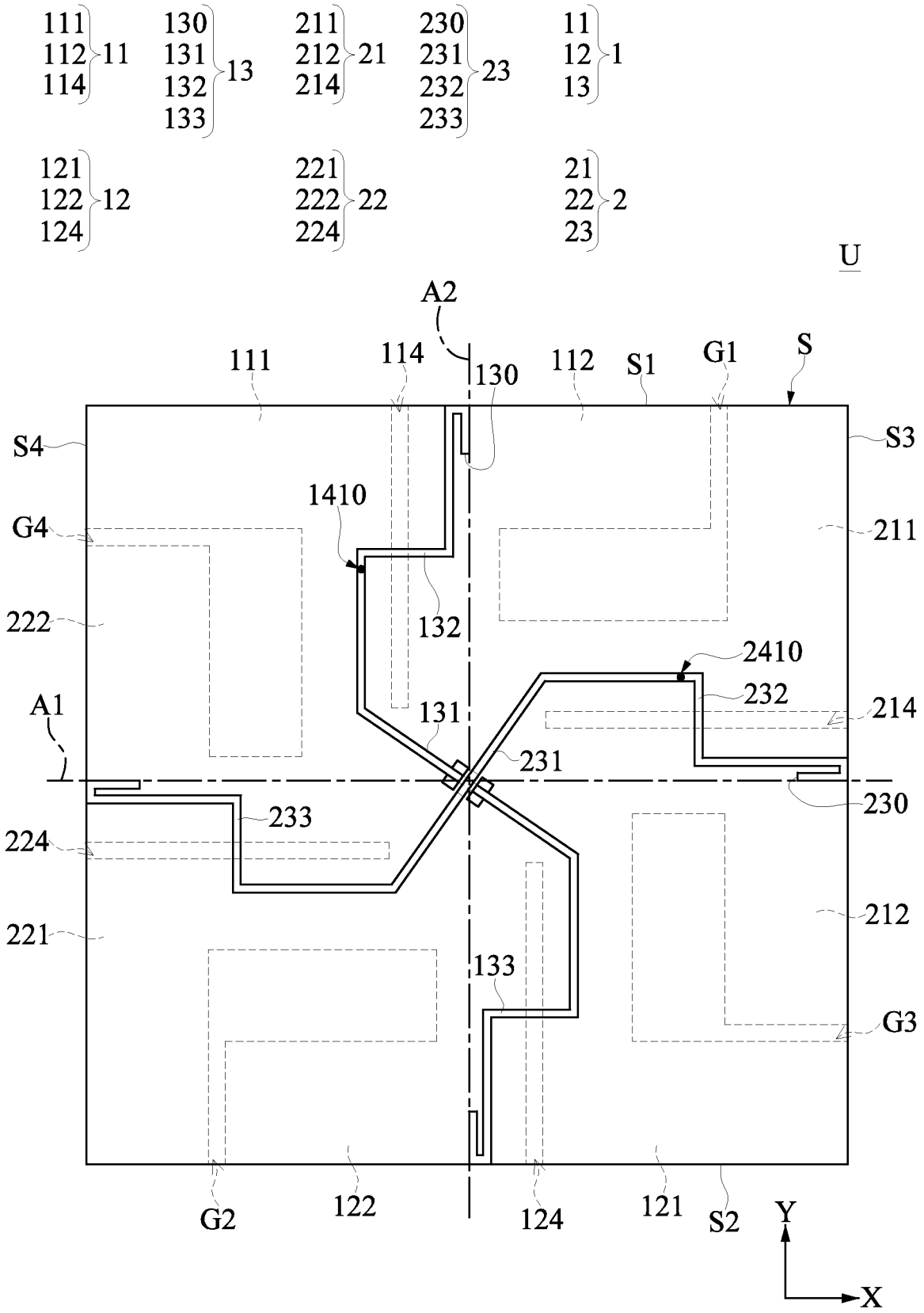
FIG. 3 is a schematic top view of the antenna structure according to the first embodiment of the present disclosure.
Figure 4:
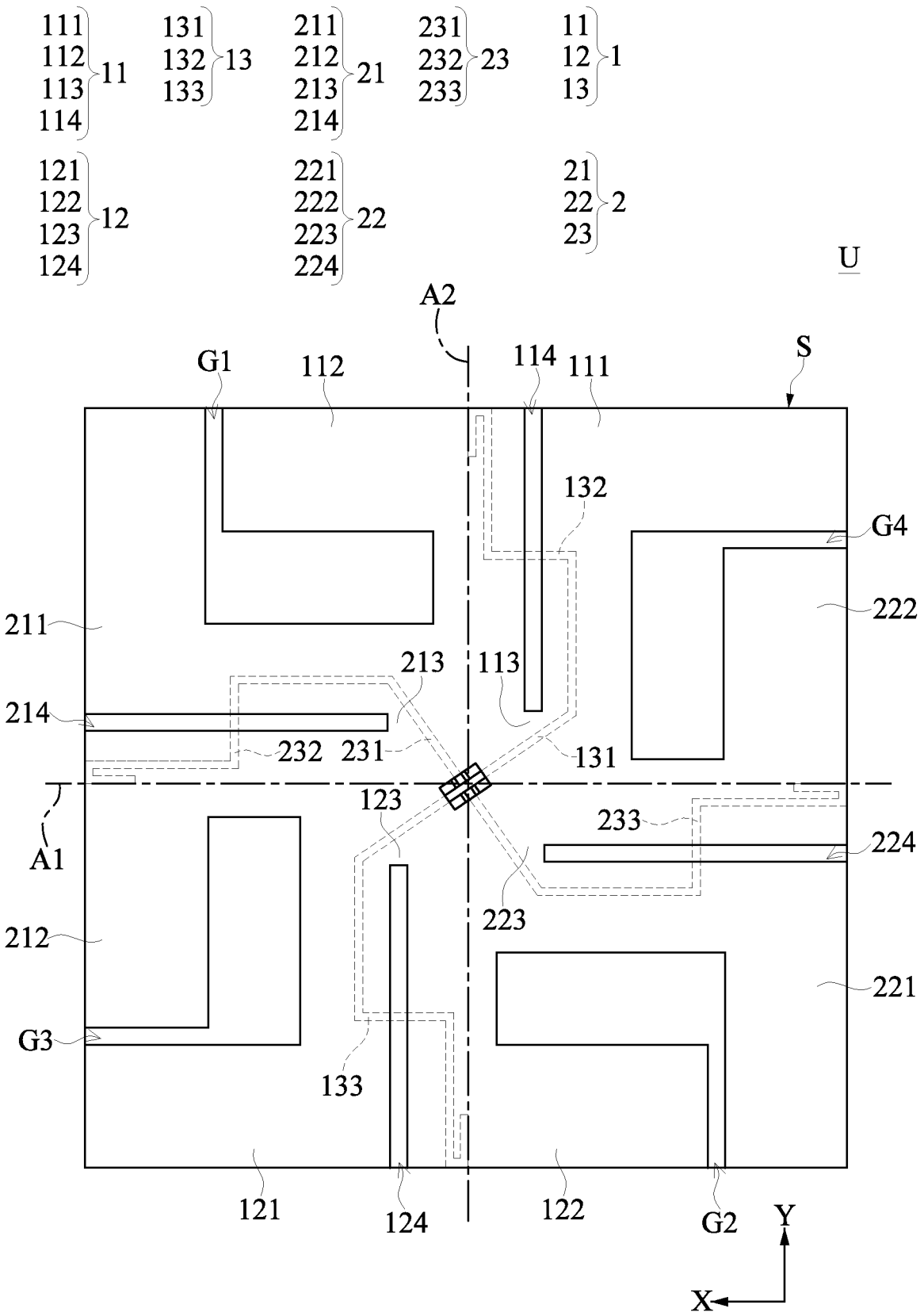
FIG. 4 is a schematic view of the antenna structure according to the first embodiment of the present disclosure from another perspective.

Firstly, FIG. 1 is a schematic perspective view of an antenna structure according to a first embodiment of the present disclosure, FIG. 2 is a schematic perspective exploded view of the antenna structure according to the first embodiment of the present disclosure, FIG. 3 is a schematic top view of the antenna structure according to the first embodiment of the present disclosure, and FIG. 4 is a schematic diagram of the antenna structure according to the first embodiment of the present disclosure from another perspective. The first embodiment of the present disclosure provides an antenna structure U, including a substrate S, a first polarization antenna group 1, and a second polarization antenna group 2, and the first polarization antenna group 1 and the second polarization antenna group 2 may be disposed on the substrate S. In addition, for example, a polarization direction of the first polarization antenna group 1 and a polarization direction of the second polarization antenna group 2 may be different from each other, and in a preferable implementation, the polarization direction of the first polarization antenna group 1 and the polarization direction of the second polarization antenna group 2 may be essentially orthogonal, so as to improve an isolation degree between the first polarization antenna group 1 and the second polarization antenna group 2, thereby reducing radiation signal interference. In addition, in an implementation of the present disclosure, the first polarization antenna group 1 may be a horizontal polarization antenna, and the second polarization antenna group 2 may be a vertical polarization antenna, but the present disclosure is not limited thereto. In addition, the present disclosure can have a feature of multi-input multi-output (MIMO), that is, two data streams may be simultaneously transmitted in a same operating frequency band.

Based on the above, the substrate S may be defined with a first axis A1 and a second axis A2 perpendicular to the first axis A1. For example, the first axis A1 may be a horizontal axis, the second axis A2 may be a vertical axis, the first axis A1 may be a horizontal central axis of the substrate S, and the second axis A2 may be a vertical central axis of the substrate S, but the present disclosure is not limited thereto. In addition, the substrate S may include a first surface SF1 and a second surface SF2 relative to the first surface SF1. It should be noted that the substrate S may be an epoxy-glass fiber substrate (FR-4) or Rogers®, but the present disclosure is not limited thereto.

Based on the above, the first polarization antenna group 1 may include a first dipole antenna 11, a second dipole antenna 12, a first wire 13, and a first feeding member 14. The second polarization antenna group 2 may include a third dipole antenna 21, a fourth dipole antenna 22, a second wire 23, and a second feeding member 24. Further, the first dipole antenna 11, the second dipole antenna 12, the third dipole antenna 21, and the fourth dipole antenna 22 may be disposed on the second surface SF2 of the substrate S, and are connected to one another. In other words, the first dipole antenna 11, the second dipole antenna 12, the third dipole antenna 21, and the fourth dipole antenna 22 may be metal sheets integrally formed on the substrate S. In addition, the first wire 13 may be disposed on the substrate S, and the first wire 13 is separate from and coupled to the first dipole antenna 11 and the second dipole antenna 12, so that the first wire 13 is used to couple and excite the first dipole antenna 11 and the second dipole antenna 12. The second wire 23 may be disposed on the substrate S, and the second wire 23 is separate from and coupled to the third dipole antenna 21 and the fourth dipole antenna 22, so that the second wire 23 is used to couple and excite the third dipole antenna 21 and the fourth dipole antenna 22. In addition, the first feeding member 14 may be electrically connected between the first wire 13 and the first dipole antenna 11 or the second dipole antenna 12, and the second feeding member 24 may be electrically connected between the second wire 23 and the third dipole antenna 21 or the fourth dipole antenna 22. Moreover, it should be particularly noted that, the term "connect" refers to a physical connection that may be a direct or indirect connection between two components, and the term "couple" refers to a non-physical connection between two components, and occurs by electric field energy generated by a current of one component exciting electric field energy of another component.

Based on the above, further referring to FIG. 1 to FIG. 3, for example, the first feeding member 14 and the second feeding member 24 may each be a coaxial cable, but the present disclosure is not limited thereto. In addition, the first feeding member 14 may have a first feeding end 141 and a first grounding end 142, and the second feeding member 24 may have a second feeding end 241 and a second grounding end 242. The first feeding end 141 may be electrically connected to the first wire 13, the first grounding end 142 may be electrically connected to the first dipole antenna 11 or the second dipole antenna 12, the second feeding end 241 may be electrically connected to the second wire 23, and the second grounding end 242 may be electrically connected to the third dipole antenna 21 or the fourth dipole antenna 22. In addition, a connection position between the first feeding end 141 and the first wire 13 may be defined as a first feeding position 1410, and a connection position between the second feeding end 241 and the second wire 23 may be defined as a second feeding position 2410. Preferably, the first grounding end 142 may be electrically connected to the first dipole antenna 11 below the first feeding position 1410, for example, a first connection body 1112 or a second connection body 1122 (referring to FIG. 5), and the second grounding end 242 may be electrically connected to the third dipole antenna 21 below the second feeding position 2410, for example, a fifth connection body 2112 or a sixth connection body 2122 (referring to FIG. 5). In other words, a vertical projection of the first feeding position 1410 on the substrate S at least partially overlaps with a vertical projection of the dipole antenna electrically connected to the first grounding end 142 on the substrate S, and a vertical projection of the second feeding position 2410 on the substrate S at least partially overlaps with a vertical projection of the dipole antenna electrically connected to the second grounding end 242 on the substrate S.

Based on the above, the first feeding position 1410 and one end portion 130 of the first wire 13 have a first predetermined length therebetween, and the second feeding position 2410 and one end portion 230 of the second wire 23 have a second predetermined length therebetween. The first predetermined length is approximately ¼ times a total length of the first wire 13, and the second predetermined length is approximately ¼ times a total length of the second wire. In other words, a length between the first feeding position 1410 and the other end portion (not labeled in the figure) of the first wire 13 is approximately ¾ times the total length of the first wire 13, and a length between the second feeding position 2410 and the other end portion (not labeled in the figure) of the second wire 23 is approximately ¾ times the total length of the second wire 23. In addition, it should be noted that the total length of the first wire 13 is a distance between the two end portions of the first wire 13, and the total length of the second wire 23 is a distance between the two end portions of the second wire 23.

Based on the above, further, the first wire 13 may have a first electrical length, and the first electrical length is approximately ¾ times a wavelength corresponding to the antenna structure U being operated at a center operating frequency in an operating frequency band. In addition, the second wire 23 may have a second electrical length, and the second electrical length is approximately ¾ times the wavelength corresponding to the antenna structure U being operated at the center operating frequency in the operating frequency band. In addition, the first electrical length and the second electrical length are respectively the total length of the first wire 13 and the total length of the second wire, and calculation manners thereof are calculating a distance between the two end portions of the first wire 13 and calculating a distance between the two end portions of the second wire 23, respectively. In addition, it should be noted that, that both the first electrical length and the second electrical length are approximately ¾ times the wavelength corresponding to the antenna structure U being operated at the center operating frequency in the operating frequency band indicates that the first electrical length and the second electrical length are plus or minus 5% of ¾ times the wavelength corresponding to the antenna structure U being operated at the center operating frequency in the operating frequency band, but the present disclosure is not limited thereto. For example, in terms of the present disclosure, the antenna structure U provided in the present disclosure is capable of generating an operating frequency band having a frequency range between 1,800 MHz and 4,200 MHz, but the present disclosure is not limited thereto. Therefore, the antenna structure U provided in the present disclosure may be applied to an operating frequency band that has a frequency range between 1,800 MHz and 4,200 MHz and that is in sub 6 GHz in an operating frequency band in a 5th generation mobile communications technology (5G).

Then, referring to FIG. 1 to FIG. 4 again, the first dipole antenna 11, the second dipole antenna 12, the third dipole antenna 21, and the fourth dipole antenna 22 may be disposed on the second surface SF2 of the substrate S. The second wire 23 may be disposed on the first surface SF1 of the substrate S, and a part of the first wire 13 is also disposed on the first surface SF1 of the substrate S. In addition, it should be noted that, to avoid a mutual connection between the first wire 13 and the second wire 23, the other part of the first wire 13 may be disposed on the second surface SF2 of the substrate S. Specifically, the substrate S may include a first through hole SV1 and a second through hole SV2 that pass through the first surface SF1 and the second surface SF2, the part of the first wire 13 that is disposed on the first surface SF1 may extend onto the second surface SF2 through the first through hole SV1, and the other part of the first wire 13 that is disposed on the second surface SF2 and that extends onto the second surface SF2 may further extend onto the first surface SF1 through the second through hole SV2. In other words, the first wire 13 may be prevented from coming in contact with the second wire 23 through the first through hole SV1 and the second through hole SV2.

Then, referring to FIG. 3 and FIG. 4 again, the first dipole antenna 11 may include a first radiation portion 111, a second radiation portion 112, and a first connection portion 113 connected to the first radiation portion 111 and the second radiation portion 112, and a first groove 114 may be formed between the first radiation portion 111 and the second radiation portion 112. In addition, the second dipole antenna 12 may include a third radiation portion 121, a fourth radiation portion 122, and a second connection portion 123 connected to the third radiation portion 121 and the fourth radiation portion 122. A second groove 124 may be formed between the third radiation portion 121 and the fourth radiation portion 122, and the first connection portion 113 is electrically connected to the second connection portion 123. Further, the first dipole antenna 11 and the second dipole antenna 12 may be respectively disposed on two opposite sides of the first axis A1, and the first groove 114 and the second groove 124 may be respectively disposed on two opposite sides of the second axis A2.

Based on the above, the third dipole antenna 21 may include a fifth radiation portion 211, a sixth radiation portion 212, and a third connection portion 213 connected to the fifth radiation portion 211 and the sixth radiation portion 212. A third groove 214 may be formed between the fifth radiation portion 211 and the sixth radiation portion 212, and the third connection portion 213 is electrically connected to the second connection portion 123. In addition, the fourth dipole antenna 22 may include a seventh radiation portion 221, an eighth radiation portion 222, and a fourth connection portion 223 connected to the seventh radiation portion 221 and the eighth radiation portion 222. A fourth groove 224 may be formed between the seventh radiation portion 221 and the eighth radiation portion 222, and the fourth connection portion 223 is electrically connected to the third connection portion 213. Further, the third dipole antenna 21 and the fourth dipole antenna 22 may be respectively disposed on the two opposite sides of the second axis A2, and the third groove 214 and the fourth groove 224 may be respectively disposed on the two opposite sides of the first axis A1. Therefore, the first dipole antenna 11, the second dipole antenna 12, the third dipole antenna 21, and the fourth dipole antenna 22 may form an architecture having a shape similar to the letter "T", and can be connected to one another through the first connection portion 113, the second connection portion 123, the third connection portion 213, and the fourth connection portion 223.

Based on the above, an opening direction of the first groove 114 may face a first direction (a positive Y direction), and an opening direction of the second groove 124 faces a second direction (a negative Y direction), where the first direction (the positive Y direction) and the second direction (the negative Y direction) are different from each other. An opening direction of the third groove 214 may face a third direction (a positive X direction), and an opening direction of the fourth groove 224 may face a fourth direction (a negative X direction), where the third direction (the positive X direction) and the fourth direction (the negative X direction) are different from each other. For example, in terms of the present disclosure, the first direction (the positive Y direction) and the second direction (the negative Y direction) may be opposite to each other, the third direction (the positive X direction) and the fourth direction (the negative X direction) may be opposite to each other, and the first direction (the positive Y direction) and the third direction (the positive X direction) are perpendicular to each other.

Then, referring to FIG. 1 to FIG. 4 again, the first wire 13 may include a first wire segment body 131, a first segment 132 connected to one end of the first wire segment body 131, and a second segment 133 connected to the other end of the first wire segment body 131. The second wire 23 may include a second wire segment body 231, a third segment 232 connected to one end of the second wire segment body 231, and a fourth segment 233 connected to the other end of the second wire segment body 231. In addition, segments of the first wire 13 are perpendicular to segments of the second wire 23. For example, a vertical projection of the first wire segment body 131 on the substrate S and a vertical projection of the second wire segment body 231 on the substrate S are perpendicular to each other, and an extending direction of the first segment 132 and the second segment 133 is perpendicular to an extending direction of the third segment 232 and the fourth segment 233. For example, an extending direction of a vertical projection of the first segment 132 and a vertical projection of the second segment 133 on the substrate S is perpendicular to an extending direction of a vertical projection of the third segment 232 and a vertical projection of the fourth segment 233 on the substrate S. Therefore, a polarization direction of the first polarization antenna group 1 and a polarization direction of the second polarization antenna group 2 may be essentially orthogonal.

Further, the vertical projection of the first segment 132 on the substrate S overlaps with a vertical projection of the first radiation portion 111 and a vertical projection of the second radiation portion 112 on the substrate S, that is, the first segment 132 can traverse the first groove 114, the first radiation portion 111, and the second radiation portion 112, and the vertical projection of the first segment 132 on the substrate S also overlaps with a vertical projection of the first groove 114 on the substrate S. In addition, the vertical projection of the second segment 133 on the substrate S overlaps with a vertical projection of the third radiation portion 121 and a vertical projection of the fourth radiation portion 122 on the substrate S, that is, the second segment 133 can traverse the second groove 124, the third radiation portion 121, and the fourth radiation portion 122, and the vertical projection of the second segment 133 on the substrate S also overlaps with a vertical projection of the second groove 124 on the substrate S. In addition, the vertical projection of the third segment 232 on the substrate S overlaps with a vertical projection of the fifth radiation portion 211 and a vertical projection of the sixth radiation portion 212 on the substrate S, that is, the third segment 232 can traverse the third groove 214, the fifth radiation portion 211, and the sixth radiation portion 212, and the vertical projection of the third segment 232 on the substrate S also overlaps with a vertical projection of the third groove 214 on the substrate S. In addition, the vertical projection of the fourth segment 233 on the substrate S overlaps with a vertical projection of the seventh radiation portion 221 and a vertical projection of the eighth radiation portion 222 on the substrate S, that is, the fourth segment 233 can traverse the fourth groove 224, the seventh radiation portion 221, and the eighth radiation portion 222, and the vertical projection of the fourth segment 233 on the substrate S also overlaps with a vertical projection of the fourth groove 224 on the substrate S.

Figure 5:
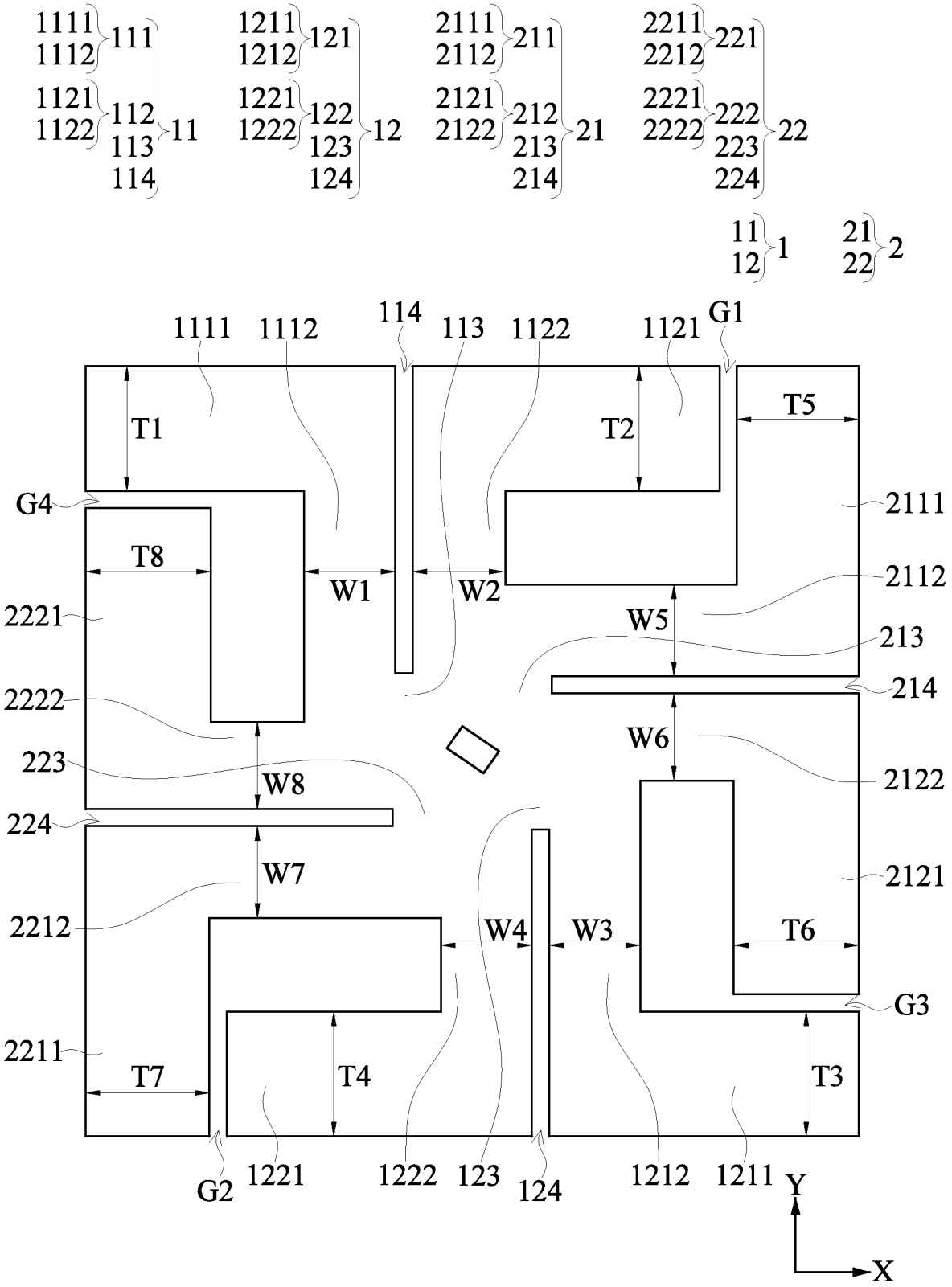
FIG. 5 is a schematic top view of a first dipole antenna, a second dipole antenna, a third dipole antenna, and a fourth dipole antenna of the antenna structure according to the first embodiment of the present disclosure.

Then, referring to FIG. 1 to FIG. 4 again, and referring to FIG. 5. FIG. 5 is a schematic top view of a first dipole antenna, a second dipole antenna, a third dipole antenna, and a fourth dipole antenna of the antenna structure according to the first embodiment of the present disclosure. Further, the substrate S may include a first side edge S1, a second side edge S2 opposite to the first side edge S1, a third side edge S3 connected between the first side edge S1 and the second side edge S2, and a fourth side edge S4 opposite to the third side edge S3 and connected between the first side edge S1 and the second side edge S2. In addition, an opening end of the first groove 114 may be located on the first side edge S1, an opening end of the second groove 124 may be located on the second side edge S2, an opening end of the third groove 214 may be located on the third side edge S3, and an opening end of the fourth groove 224 may be located on the fourth side edge S4.

Based on the above, a first groove body G1 may be arranged between the first dipole antenna 11 and the third dipole antenna 21, a second groove body G2 may be arranged between the second dipole antenna 12 and the fourth dipole antenna 22, a third groove body G3 may be arranged between the third dipole antenna 21 and the second dipole antenna 12, and a fourth groove body G4 may be arranged between the fourth dipole antenna 22 and the first dipole antenna 11. An opening end of the first groove body G1 may be located on the first side edge S1, an opening end of the second groove body G2 may be located on the second side edge S2, an opening end of the third groove body G3 may be located on the third side edge S3, and an opening end of the fourth groove body G4 may be located on the fourth side edge S4. Further, the first dipole antenna 11, the second dipole antenna 12, the third dipole antenna 21, and the fourth dipole antenna 22 can be connected to one another through the first connection portion 113, the second connection portion 123, the third connection portion 213, and the fourth connection portion 223. Therefore, the opening end of the first groove body G1 may be located between the first radiation portion 111 of the first dipole antenna 11 and the eighth radiation portion 222 of the fourth dipole antenna 22. The opening end of the second groove body G2 may be located between the third radiation portion 121 of the second dipole antenna 12 and the sixth radiation portion 212 of the third dipole antenna 21. The opening end of the third groove body G3 may be located between the fifth radiation portion 211 of the third dipole antenna 21 and the second radiation portion 112 of the first dipole antenna 11. The opening end of the fourth groove body G4 may be located between the seventh radiation portion 221 of the fourth dipole antenna 22 and the fourth radiation portion 122 of the second dipole antenna 12.

Based on the above, it should be noted that neither the vertical projection of the first wire 13 on the substrate S nor the vertical projection of the second wire 23 on the substrate S overlaps with a vertical projection of the first groove body G1 on the substrate S, a vertical projection of the second groove body G2 on the substrate S, a vertical projection of the third groove body G3 on the substrate S, and a vertical projection of the fourth groove body G4 on the substrate S.

Then, referring to FIG. 1 to FIG. 5 again, the first radiation portion 111 of the first dipole antenna 11 may include a first radiation body 1111 and a first connection body 1112 electrically connected between the first radiation body 1111 and the first connection portion 113. The second radiation portion 112 of the first dipole antenna 11 includes a second radiation body 1121 and a second connection body 1122 electrically connected between the second radiation body 1121 and the first connection portion 113. In addition, in terms of the first embodiment, a first preset width T1 of the first radiation body 1111 is equal to a second preset width T2 of the second radiation body 1121, and a first predetermined width W1 of the first connection body 1112 is equal to a second predetermined width W2 of the second connection body 1122, but the present disclosure is not limited thereto.

Based on the above, further, the third radiation portion 121 of the second dipole antenna 12 may include a third radiation body 1211 and a third connection body 1212 electrically connected between the third radiation body 1211 and the second connection portion 123. The fourth radiation portion 122 of the second dipole antenna 12 includes a fourth radiation body 1221 and a fourth connection body 1222 electrically connected between the fourth radiation body 1221 and the second connection portion 123. In addition, in terms of the first embodiment, a third preset width T3 of the third radiation body 1211 is equal to a fourth preset width T4 of the fourth radiation body 1221, and a third predetermined width W3 of the third connection body 1212 is equal to a fourth predetermined width W4 of the fourth connection body 1222, but the present disclosure is not limited thereto.

Based on the above, further, the fifth radiation portion 211 of the third dipole antenna 21 may include a fifth radiation body 2111 and a fifth connection body 2112 electrically connected between the fifth radiation body 2111 and the third connection portion 213. The sixth radiation portion 212 of the third dipole antenna 21 includes a sixth radiation body 2121 and a sixth connection body 2122 electrically connected between the sixth radiation body 2121 and the third connection portion 213. In addition, in terms of the first embodiment, a fifth preset width T5 of the fifth radiation body 2111 is equal to a sixth preset width T6 of the sixth radiation body 2121, and a fifth predetermined width W5 of the fifth connection body 2112 is equal to a sixth predetermined width W6 of the sixth connection body 2122, but the present disclosure is not limited thereto.

Based on the above, further, the seventh radiation portion 221 of the fourth dipole antenna 22 may include a seventh radiation body 2211 and a seventh connection body 2212 electrically connected between the seventh radiation body 2211 and the fourth connection portion 223. The eighth radiation portion 222 of the fourth dipole antenna 22 includes an eighth radiation body 2221 and an eighth connection body 2222 electrically connected between the eighth radiation body 2221 and the fourth connection portion 223. In addition, in terms of the first embodiment, a seventh preset width T7 of the seventh radiation body 2211 is equal to an eighth preset width T8 of the eighth radiation body 2221, and a seventh predetermined width W7 of the seventh connection body 2212 is equal to an eighth predetermined width W8 of the eighth connection body 2222, but the present disclosure is not limited thereto.

Figure 6:
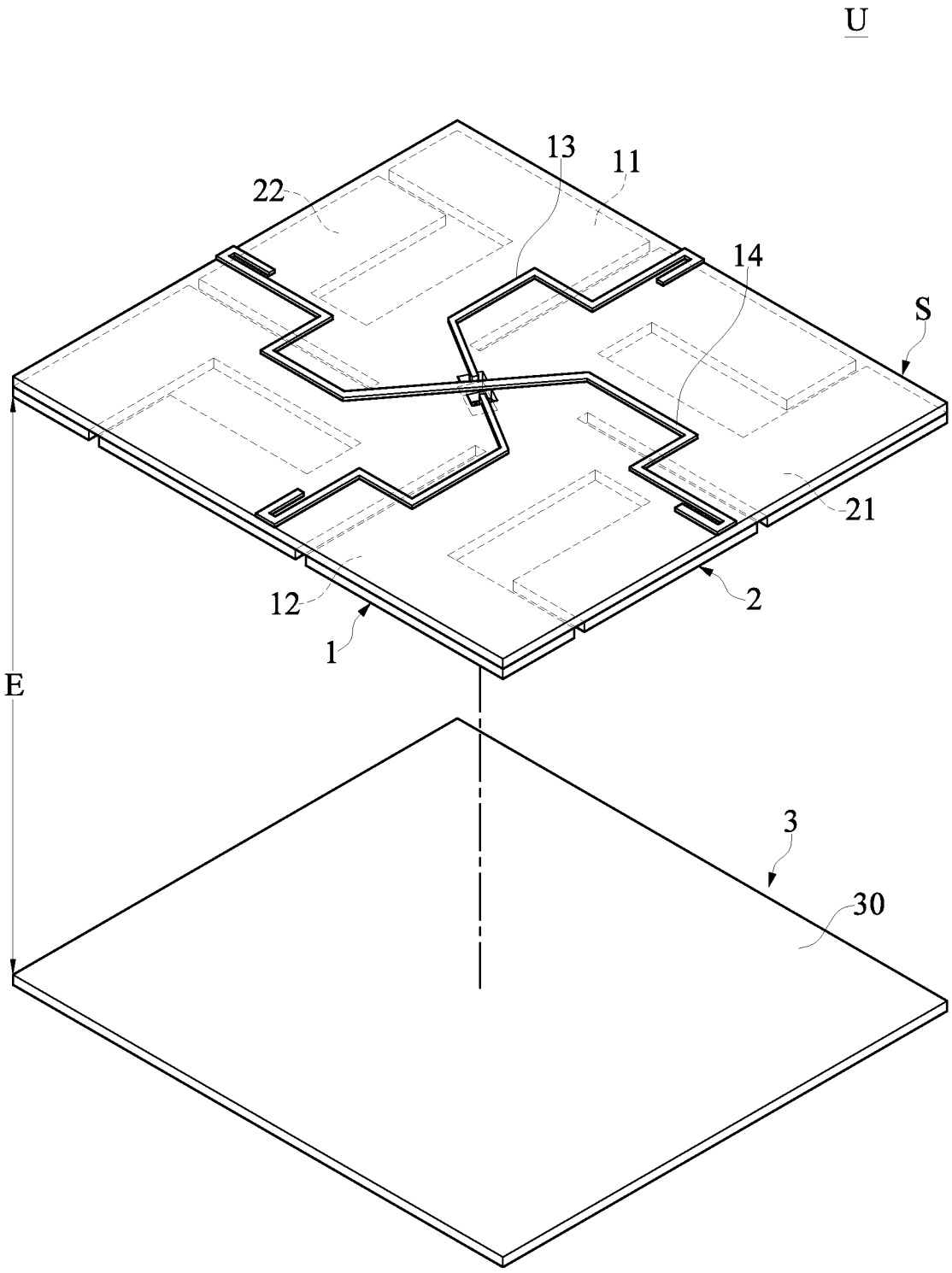
FIG. 6 is another schematic perspective view of the antenna structure according to the first embodiment of the present disclosure.

Then, refer to FIG. 6. FIG. 6 is another schematic perspective view of the antenna structure according to the first embodiment of the present disclosure. In the implementation in FIG. 6, the antenna structure U may further include a reflecting plate 3, a reflecting surface 30 of the reflecting plate 3 and the first dipole antenna 11 have a predetermined distance E therebetween, the second dipole antenna 12, the third dipole antenna 21, and the fourth dipole antenna 22, and the predetermined distance E may be approximately ¼ times a wavelength corresponding to the antenna structure U being operated at a center operating frequency in an operating frequency band, but the present disclosure is not limited thereto. Therefore, the reflecting plate 3 may be disposed to further improve gains of the antenna structure U.

Second Embodiment

Figure 7:
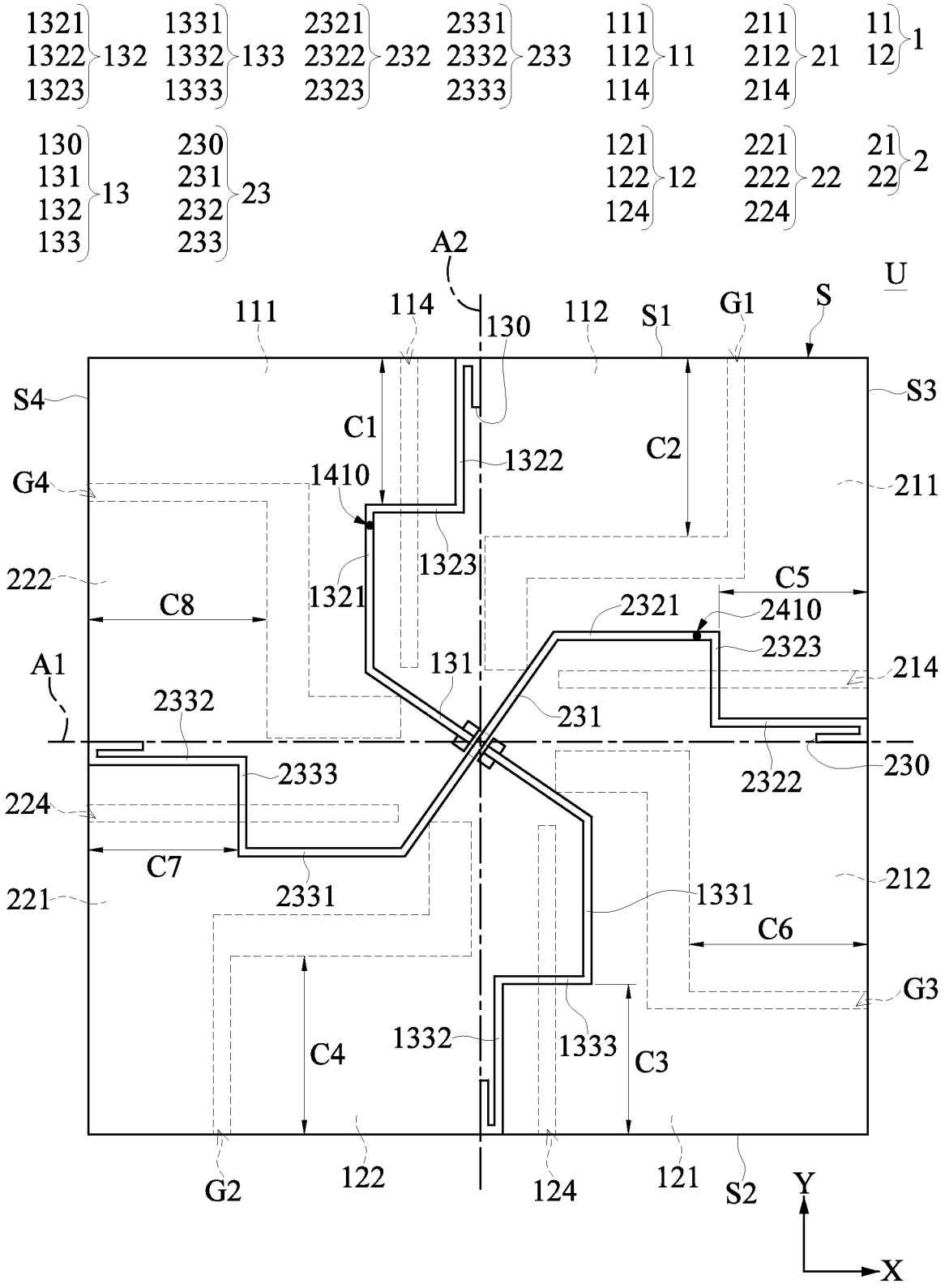
FIG. 7 is a schematic top view of an antenna structure according to a second embodiment of the present disclosure.
Figure 8:
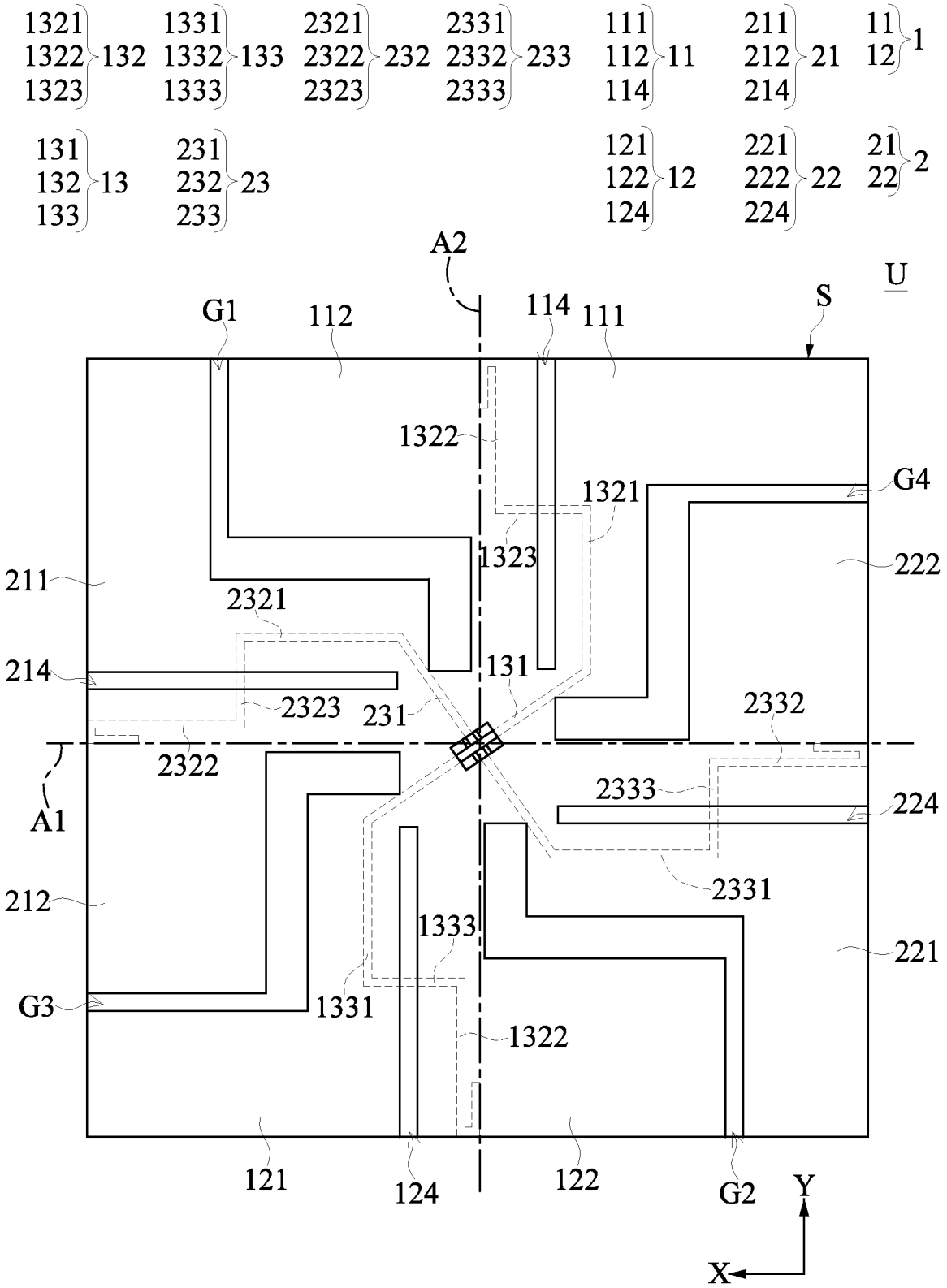
FIG. 8 is a schematic view of the antenna structure according to the second embodiment of the present disclosure from another perspective.
Figure 9:
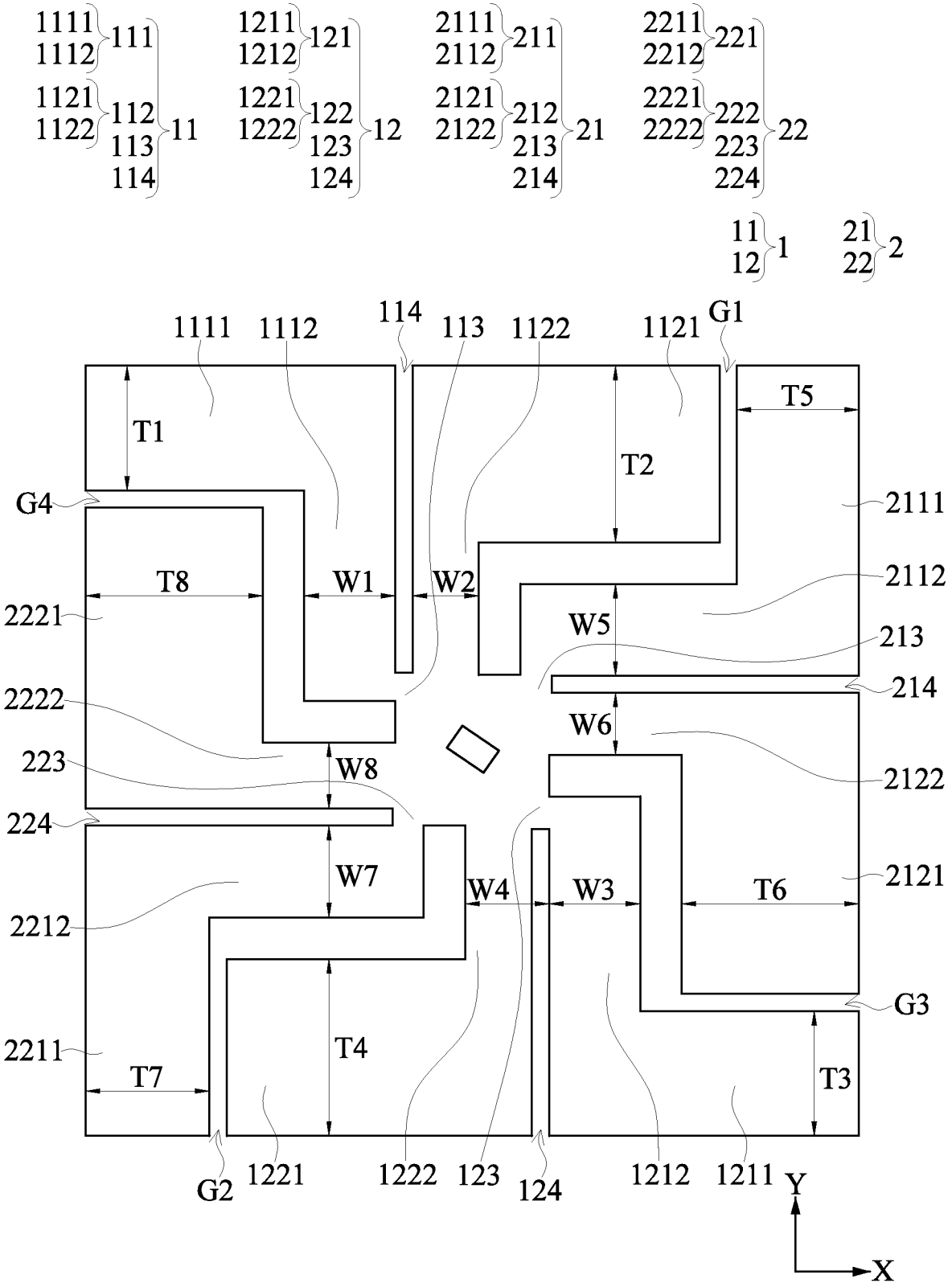
FIG. 9 is a schematic top view of a first dipole antenna, a second dipole antenna, a third dipole antenna, and a fourth dipole antenna of the antenna structure according to the second embodiment of the present disclosure.

First, referring to FIG. 7 to FIG. 9. FIG. 7 is a schematic top view of an antenna structure according to a second embodiment of the present disclosure, FIG. 8 is a schematic view of an antenna structure according to the second embodiment of the present disclosure from another perspective, and FIG. 9 is a schematic top view of a first dipole antenna, a second dipole antenna, a third dipole antenna, and a fourth dipole antenna of the antenna structure according to the second embodiment of the present disclosure. As shown by a comparison between FIG. 7 and FIG. 3, a greatest difference between the second embodiment and the first embodiment lies in that shapes of the first dipole antenna, the second dipole antenna, the third dipole antenna, and the fourth dipole antenna provided in the second embodiment may be different from those in the first embodiment. However, it should be noted that, other structural features shown in the second embodiment are similar to those described in the foregoing embodiment, and details are not described herein again.

Based on the above, in terms of the second embodiment, a first preset width T1 of a first radiation body 1111 is less than a second preset width T2 of a second radiation body 1121, and a first predetermined width W1 of a first connection body 1112 is greater than a second predetermined width W2 of a second connection body 1122. In addition, preferably, a width ratio of the first predetermined width W1 to the second predetermined width W2 is approximately 4:3.

Based on the above, further, a third preset width T3 of a third radiation body 1211 is less than a fourth preset width T4 of a fourth radiation body 1221, and a third predetermined width W3 of a third connection body 1212 is greater than a fourth predetermined width W4 of a fourth connection body 1222. In addition, preferably, a width ratio of the third predetermined width W3 to the fourth predetermined width W4 is approximately 4:3.

Based on the above, further, a fifth preset width T5 of a fifth radiation body 2111 is less than a sixth preset width T6 of a sixth radiation body 2121, and a fifth predetermined width W5 of a fifth connection body 2112 is greater than a sixth predetermined width W6 of a sixth connection body 2122. In addition, preferably, a width ratio of the fifth predetermined width W5 to the sixth predetermined width W6 is approximately 4:3.

Based on the above, further, a seventh preset width T7 of a seventh radiation body 2211 is less than an eighth preset width T8 of an eighth radiation body 2221, and a seventh predetermined width W7 of a seventh connection body 2212 is greater than an eighth predetermined width W8 of an eighth connection body 2222. In addition, preferably, a width ratio of the seventh predetermined width W7 to the eighth predetermined width W8 is approximately 4:3.

Then, referring to FIG. 7 to FIG. 9 again, a first feeding end 141 may be electrically connected to a first wire 13, a first grounding end 142 may be electrically connected to the first dipole antenna 11 or the second dipole antenna 12, a second feeding end 241 may be electrically connected to a second wire 23, and a second grounding end 242 may be electrically connected to the third dipole antenna 21 or the fourth dipole antenna 22. In addition, a connection position between the first feeding end 141 and the first wire 13 may be defined as a first feeding position 1410, and a connection position between the second feeding end 241 and the second wire 23 may be defined as a second feeding position 2410. The first grounding end 142 may be electrically connected to the first dipole antenna 11 below the first feeding position 1410, for example, the first connection body 1112 or the second connection body 1122, and the second grounding end 242 may be electrically connected to the third dipole antenna 21 below the second feeding position 2410, for example, the fifth connection body 2112 or the sixth connection body 2122. In other words, a vertical projection of the first feeding position 1410 on a substrate S at least partially overlaps with a vertical projection of a dipole antenna electrically connected to the first grounding end 142 on the substrate S, and a vertical projection of the second feeding position 2410 on the substrate S at least partially overlaps with a vertical projection of a dipole antenna electrically connected to the second grounding end 242 on the substrate S. Preferably, in terms of the second embodiment, the first grounding end 142 may be electrically connected to the first connection body 1112 because the first predetermined width W1 of the first connection body 1112 is greater than the second predetermined width W2 of the second connection body 1122. In addition, the second grounding end 242 may be electrically connected to the fifth connection body 2112 because the fifth predetermined width W5 of the fifth connection body 2112 is greater than the sixth predetermined width W6 of the sixth connection body 2122. Therefore, a grounding end is connected to a connection body having a relatively large width to improve impedance matching between a dipole antenna and a wire.

Then, referring to FIG. 7 to FIG. 9 again, a first segment 132 may traverse a first radiation portion 111, a second radiation portion 112, and a first groove 114. In addition, the first segment 132 may include a first section 1321, a second section 1322, and a first traverse section 1323 connected between the first section 1321 and the second section 1322, and a vertical projection of the first traverse section 1323 on the substrate S overlaps with a vertical projection of the first groove 114, a vertical projection of the first radiation portion 111, and a vertical projection of the second radiation portion 112 on the substrate S. In addition, the first section 1321 may be connected between a first wire segment body 131 and the first traverse section 1323, a vertical projection of the first section 1321 on the substrate S overlaps with a vertical projection of the first radiation portion 111 on the substrate S, and a vertical projection of the second section 1322 on the substrate S overlaps with a vertical projection of the second radiation portion 112 on the substrate S. In addition, the first traverse section 1323 of the first wire 13 and a first side edge S1 of the substrate S have a first predetermined gap C1 therebetween, and an edge of the second radiation body 1121 close to the first connection portion 113 of the first dipole antenna 11 and the first side edge S1 have a second predetermined gap C2 therebetween, where the first predetermined gap C1 may be less than the second predetermined gap C2. In addition, for example, the first section 1321 may be perpendicular to the first side edge S1, the first section 1321 and the first wire segment body 131 have an angle therebetween that is greater than 90 degrees, and the first section 1321 may be perpendicular to the first traverse section 1323, but the present disclosure is not limited thereto.

Further, a second segment 133 may traverse a third radiation portion 121, a fourth radiation portion 122, and a second groove 124. In addition, the second segment 133 may include a third section 1331, a fourth section 1332, and a second traverse section 1333 connected between the third section 1331 and the fourth section 1332, and a vertical projection of the second traverse section 1333 on the substrate S overlaps with a vertical projection of the second groove 124, a vertical projection of the third radiation portion 121, and a vertical projection of the fourth radiation portion 122 on the substrate S. In addition, the third section 1331 may be connected between the first wire segment body 131 and the second traverse section 1333, a vertical projection of the third section 1331 on the substrate S overlaps with a vertical projection of the third radiation portion 121 on the substrate S, and a vertical projection of the fourth section 1332 on the substrate S overlaps with a vertical projection of the fourth radiation portion 122 on the substrate S. In addition, the second traverse section 1333 of the first wire 13 and a second side edge S2 of the substrate S have a third predetermined gap C3 therebetween, and an edge of the fourth radiation body 1221 close to the second connection portion 123 of the second dipole antenna 12 and the second side edge S2 have a fourth predetermined gap C4 therebetween, where the third predetermined gap C3 may be less than the fourth predetermined gap C4. In addition, for example, the third section 1331 may be perpendicular to the second side edge S2, a the third section 1331 and the first wire segment body 131 have an angle therebetween that is greater than 90 degrees, and the third section 1331 may be perpendicular to the second traverse section 1333, but the present disclosure is not limited thereto.

Further, a third segment 232 may traverse a fifth radiation portion 211, a sixth radiation portion 212, and a third groove 214. In addition, the third segment 232 may include a fifth section 2321, a sixth section 2322, and a third traverse section 2323 connected between the fifth section 2321 and the sixth section 2322, and a vertical projection of the third traverse section 2323 on the substrate S overlaps with a vertical projection of the third groove 214, a vertical projection of the fifth radiation portion 211, and a vertical projection of the sixth radiation portion 212 on the substrate S. In addition, the fifth section 2321 may be connected between a second wire segment body 231 and the third traverse section 2323, a vertical projection of the fifth section 2321 on the substrate S overlaps with a vertical projection of the fifth radiation portion 211 on the substrate S, and a vertical projection of the sixth section 2322 on the substrate S overlaps with a vertical projection of the sixth radiation portion 212 on the substrate S. In addition, the third traverse section 2323 of the second wire 23 and a third side edge S3 of the substrate S have a fifth predetermined gap C5 therebetween, and an edge of the sixth radiation body 2121 close to the third connection portion 213 of the third dipole antenna 21 and the third side edge S3 have a sixth predetermined gap C6 therebetween, where the fifth predetermined gap C5 may be less than the sixth predetermined gap C6. In addition, for example, the fifth section 2321 may be perpendicular to the third side edge S3, the fifth section 2321 and the second wire segment body 231 have an angle therebetween that is greater than 90 degrees, and the fifth section 2321 may be perpendicular to the third traverse section 2323, but the present disclosure is not limited thereto.

Further, a fourth segment 233 may traverse a seventh radiation portion 221, an eighth radiation portion 222, and a fourth groove 224. In addition, the fourth segment 233 may include a seventh section 2331, an eighth section 2332, and a fourth traverse section 2333 connected between the seventh section 2331 and the eighth section 2332, and a vertical projection of the fourth traverse section 2333 on the substrate S overlaps with a vertical projection of the fourth groove 224, a vertical projection of the seventh radiation portion 221, and a vertical projection of the eighth radiation portion 222 on the substrate S. In addition, the seventh section 2331 may be connected between the second wire segment body 231 and the fourth traverse section 2333, a vertical projection of the seventh section 2331 on the substrate S overlaps with a vertical projection of the seventh radiation portion 221 on the substrate S, and a vertical projection of the eighth section 2332 on the substrate S overlaps with a vertical projection of the eighth radiation portion 222 on the substrate S. In addition, the fourth traverse section 2333 of the second wire 23 and a fourth side edge S4 of the substrate S have a seventh predetermined gap C7 therebetween, and an edge of the eighth radiation body 2221 close to the fourth connection portion 223 of the fourth dipole antenna 22 and the fourth side edge S4 have an eighth predetermined gap C8 therebetween, where the seventh predetermined gap C7 may be less than the eighth predetermined gap C8. In addition, for example, the seventh section 2331 may be perpendicular to the fourth side edge S4, the seventh section 2331 and the second wire segment body 231 have an angle therebetween that is greater than 90 degrees, and the seventh section 2331 may be perpendicular to the fourth traverse section 2333, but the present disclosure is not limited thereto.

In addition, it should be noted that, the second section 1322 of the first wire 13, the fourth section 1332 of the first wire 13, the sixth section 2322 of the second wire 23, and the eighth section 2332 of the second wire 23 each have a bent portion (not labeled in the figure), a length of the bent portion disposed on the first wire 13 and a length of the bent portion disposed on the second wire 23 may be used to adjust a length of the first wire 13 and a length of the second wire 23, and the bent portion is configured to reduce an overall volume of the antenna structure U.

Further, in terms of the second embodiment, the antenna structure U provided in the second embodiment is compared with the antenna structure U provided in the first embodiment, and in the antenna structure U provided in the second embodiment, gains of a relatively low frequency range of an operating frequency band having a frequency range between 1,800 MHz to 4,200 MHz are further improved.

[Beneficial Effect of the Embodiments]

A beneficial effect of the present disclosure resides in that, in the antenna structure provided in the present disclosure, by virtue of "the first dipole antenna 11 and the second dipole antenna 12 are respectively disposed on two opposite sides of the first axis A1, and the first groove 114 and the second groove 124 are respectively disposed on two opposite sides of the second axis" and "the third dipole antenna 21 and the fourth dipole antenna 22 are respectively disposed on the two opposite sides of the second axis A2, and the third groove 214 and the fourth groove 224 are respectively disposed on the two opposite sides of the first axis A1" gains of the antenna structure U can be improved, and a bandwidth of an operating frequency band of the antenna structure U can be increased.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An antenna structure, comprising:

a substrate defined with a first axis and a second axis perpendicular to the first axis;

a first polarization antenna group disposed on the substrate, the first polarization antenna group comprising:

a first dipole antenna including a first radiation portion, a second radiation portion, and a first connection portion connected to the first radiation portion and the second radiation portion, wherein a first groove is formed between the first radiation portion and the second radiation portion;

a second dipole antenna including a third radiation portion, a fourth radiation portion, and a second connection portion connected to the third radiation portion and the fourth radiation portion, wherein a second groove is formed between the third radiation portion and the fourth radiation portion, and the first connection portion is electrically connected to the second connection portion;

a first wire separate from and coupled to the first dipole antenna and the second dipole antenna; and a first feeding member electrically connected between the first wire and the first dipole antenna or the second dipole antenna;

wherein the first dipole antenna and the second dipole antenna are respectively disposed on two opposite sides of the first axis, and the first groove and the second groove are respectively disposed on two opposite sides of the second axis; and a second polarization antenna group disposed on the substrate, the second polarization antenna group comprising:

a third dipole antenna comprising a fifth radiation portion, a sixth radiation portion, and a third connection portion connected to the fifth radiation portion and the sixth radiation portion, wherein a third groove is formed between the fifth radiation portion and the sixth radiation portion, and the third connection portion is electrically connected to the second connection portion;

a fourth dipole antenna comprising a seventh radiation portion, an eighth radiation portion, and a fourth connection portion connected to the seventh radiation portion and the eighth radiation portion, wherein a fourth groove is formed between the seventh radiation portion and the eighth radiation portion, and the fourth connection portion is electrically connected to the third connection portion;

a second wire separate from and coupled to the third dipole antenna and the fourth dipole antenna; and a second feeding member electrically connected between the second wire and the third dipole antenna or the fourth dipole antenna;

wherein the third dipole antenna and the fourth dipole antenna are respectively disposed on two opposite sides of the second axis, and the third groove and the fourth groove are respectively disposed on two opposite sides of the first axis.

2. The antenna structure according to claim 1, wherein an opening direction of the first groove faces a first direction, and an opening direction of the second groove faces a second direction, the first direction and the second direction being opposite to each other, an opening direction of the third groove faces a third direction, and an opening direction of the fourth groove faces a fourth direction, and wherein the third direction and the fourth direction are opposite to each other; and the first direction and the third direction are perpendicular to each other.

3. The antenna structure according to claim 1, wherein the first wire has a first electrical length, the first electrical length being approximately ¾ times a wavelength corresponding to the antenna structure being operated at a center operating frequency in an operating frequency band; and the second wire has a second electrical length, the second electrical length being approximately ¾ times a wavelength corresponding to the antenna structure being operated at the center operating frequency in the operating frequency band.

4. The antenna structure according to claim 1, wherein the first wire has a first wire segment body, a first segment connected to one end of the first wire segment body, and a second segment connected to the other end of the first wire segment body; and the second wire has a second wire segment body, a third segment connected to one end of the second wire segment body, and a fourth segment connected to the other end of the second wire segment body, wherein a vertical projection of the first segment on the substrate overlaps with a vertical projection of the first radiation portion and a vertical projection of the second radiation portion on the substrate, a vertical projection of the second segment on the substrate overlaps with a vertical projection of the third radiation portion and a vertical projection of the fourth radiation portion on the substrate, a vertical projection of the third segment on the substrate overlaps with a vertical projection of the fifth radiation portion and a vertical projection of the sixth radiation portion on the substrate, and a vertical projection of the fourth segment on the substrate overlaps with a vertical projection of the seventh radiation portion and a vertical projection of the eighth radiation portion on the substrate.

5. The antenna structure according to claim 4, wherein a vertical projection of the first wire segment body on the substrate and a vertical projection of the second wire segment body on the substrate are perpendicular to each other, and a polarization direction of the first polarization antenna group and a polarization direction of the second polarization antenna group are orthogonal to each other.

6. The antenna structure according to claim 1, wherein the substrate has a first side edge, a second side edge opposite to the first side edge, a third side edge connected between the first side edge and the second side edge, and a fourth side edge opposite to the third side edge and connected between the first side edge and the second side edge, wherein an opening end of the first groove is located on the first side edge, an opening end of the second groove is located on the second side edge, an opening end of the third groove is located on the third side edge, and an opening end of the fourth groove is located on the fourth side edge; and a first groove body is arranged between the first dipole antenna and the third dipole antenna, a second groove body is arranged between the second dipole antenna and the fourth dipole antenna, a third groove body is arranged between the third dipole antenna and the second dipole antenna, and a fourth groove body is arranged between the fourth dipole antenna and the first dipole antenna, wherein an opening end of the first groove body is located on the first side edge, an opening end of the second groove body is located on the second side edge, an opening end of the third groove body is located on the third side edge, and an opening end of the fourth groove body is located on the fourth side edge.

7. The antenna structure according to claim 1, wherein a connection position between a first feeding end of the first feeding member and the first wire is defined as a first feeding position, a connection position between a second feeding end of the second feeding member and the second wire is defined as a second feeding position, the first feeding position and one end portion of the first wire have a first predetermined length therebetween, and the second feeding position and one end portion of the second wire have a second predetermined length therebetween, wherein the first predetermined length is approximately ¼ times a total length of the first wire, and the second predetermined length is approximately ¼ times a total length of the second wire.

8. The antenna structure according to claim 1, wherein the first wire has a first wire segment body, a first segment connected to one end of the first wire segment body, and a second segment connected to the other end of the first wire segment body; and the second wire has a second wire segment body, a third segment connected to one end of the second wire segment body, and a fourth segment connected to the other end of the second wire segment body, and wherein a vertical projection of the first wire segment body on the substrate and a vertical projection of the second wire segment body on the substrate are perpendicular to each other, and an extending direction of a vertical projection of the first segment and a vertical projection of the second segment on the substrate and an extending direction of a vertical projection of the third segment and a vertical projection of the fourth segment on the substrate are perpendicular to each other.

9. The antenna structure according to claim 1, wherein the first radiation portion includes a first radiation body and a first connection body electrically connected between the first radiation body and the first connection portion, the second radiation portion includes a second radiation body and a second connection body electrically connected between the second radiation body and the first connection portion, and a first predetermined width of the first connection body is greater than a second predetermined width of the second connection body.

10. The antenna structure according to claim 9, wherein a width ratio of the first predetermined width to the second predetermined width is 4:3.

11. The antenna structure according to claim 9, wherein a first preset width of the first radiation body is less than a second preset width of the second radiation body.

12. The antenna structure according to claim 9, wherein the substrate has a first side edge; the first wire has a first wire segment body, a first segment connected to one end of the first wire segment body, and a second segment connected to the other end of the first wire segment body; a vertical projection of a first traverse section of the first segment on the substrate overlaps with a vertical projection of the first groove, a vertical projection of the first radiation portion, and a vertical projection of the second radiation portion on the substrate; and the first segment and the first side edge have a first predetermined gap therebetween, and an edge of the second radiation body close to the first connection portion and the first side edge have a second predetermined gap therebetween, wherein the first predetermined gap is smaller than the second predetermined gap.

13. The antenna structure according to claim 9, wherein the first feeding member has a first feeding end and a first grounding end, the first feeding end is electrically connected to the first wire, and the first grounding end is electrically connected to the first connection body of the first dipole antenna.

* * * * *